US005640865A

United States Patent [19]

Widén

[11] Patent Number: 5,640,865

[45] Date of Patent: Jun. 24, 1997

[54] CYLINDER LOCK AND KEY COMBINATION

[75] Inventor: Bo Widén, Torshälla, Sweden

[73] Assignee: Widen and Sandh Key Partners AG, Zug, Switzerland

[21] Appl. No.: 362,524

[22] PCT Filed: Jun. 4, 1993

[86] PCT No.: PCT/SE93/00500

§ 371 Date: Jan. 4, 1995

§ 102(e) Date: Jan. 4, 1995

[87] PCT Pub. No.: WO94/01643

PCT Pub. Date: Jan. 20, 1994

[30] Foreign Application Priority Data

Jul. 6, 1992 [SE] Sweden ..... 9202094

[51] Int. Cl.[6] ..... E05B 27/10

[52] U.S. Cl. ..... 70/495; 70/419; 70/378; 70/409

[58] Field of Search ..... 70/378, 493–496, 70/405–407, 409, 411

[56] References Cited

U.S. PATENT DOCUMENTS

| | | | |
|---|---|---|---|
| 4,235,086 | 11/1980 | Genakis | 70/378 X |
| 4,356,713 | 11/1982 | Widen | 70/409 X |
| 4,393,673 | 7/1983 | Widen | 70/409 X |
| 4,638,651 | 1/1987 | Surko, Jr. | 70/495 |
| 4,756,177 | 7/1988 | Widen | 70/378 X |
| 5,067,335 | 11/1991 | Widen | 70/495 |
| 5,419,168 | 5/1995 | Field | 70/378 X |
| 5,421,179 | 6/1995 | Bergstrom | 70/495 X |

FOREIGN PATENT DOCUMENTS

| | | |
|---|---|---|
| 0231599 | 8/1987 | European Pat. Off. . |
| 3004955 | 8/1981 | Germany . |
| 3542008 | 8/1991 | Germany . |
| 455801 | 8/1988 | Sweden . |
| WO89/06733 | 7/1989 | WIPO . |

*Primary Examiner*—Suzanne Dino

*Attorney, Agent, or Firm*—Birch, Stewart, Kolasch & Birch, LLP

[57] ABSTRACT

A cylinder lock and an associated key include a rotatable cylinder key plug having a key slot into which the key is insertable. The key has a lower solid base portion with coded side recesses for engagement with side tumblers of the lock. From the solid base portion, a lip projects upwardly at a transversal distance from the rest of the key blade, and the side recesses extend partially through the lip and partially through the solid base portion. The key slot has a corresponding cross-sectional profile with a downwardly projecting tongue.

22 Claims, 3 Drawing Sheets

FIG. 1a
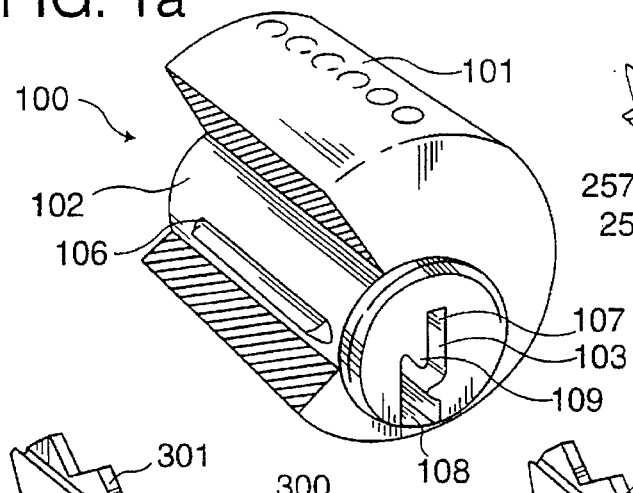
FIG. 3
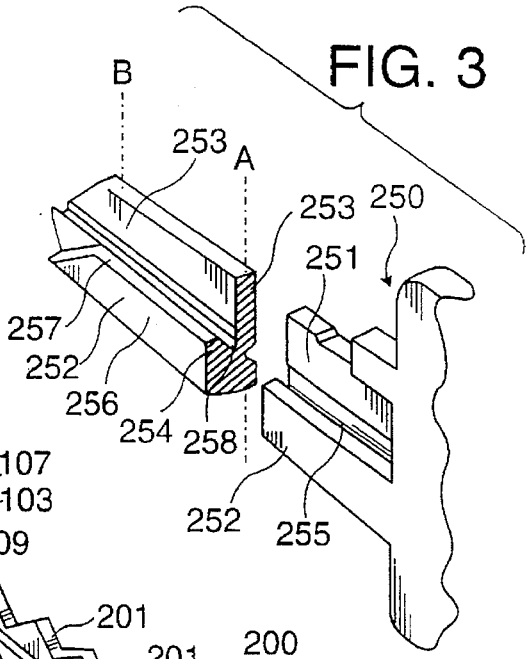
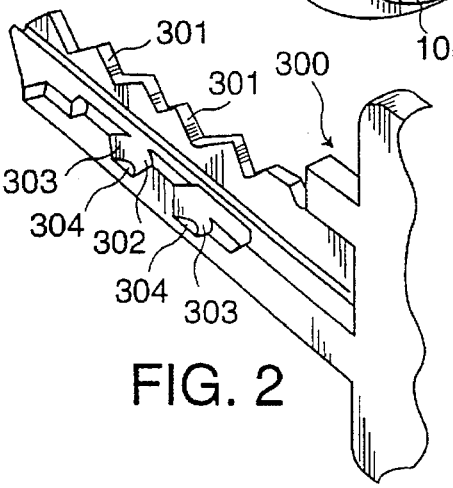
FIG. 2
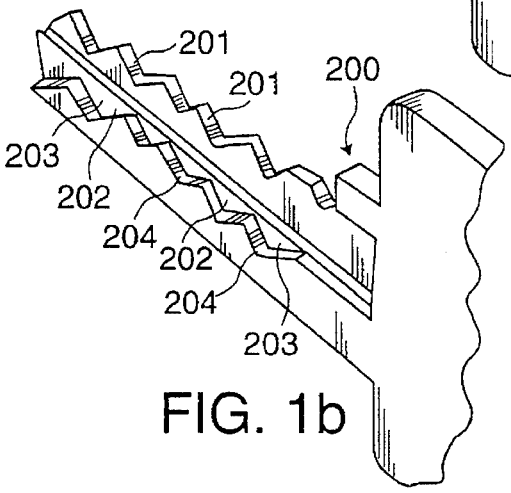
FIG. 1b
FIG. 4
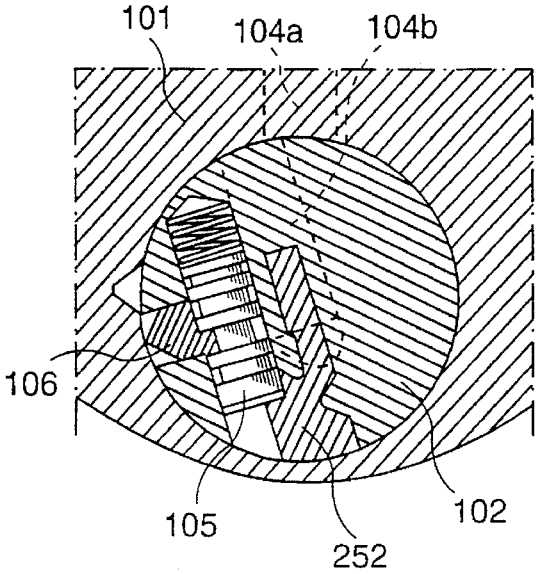
FIG. 5
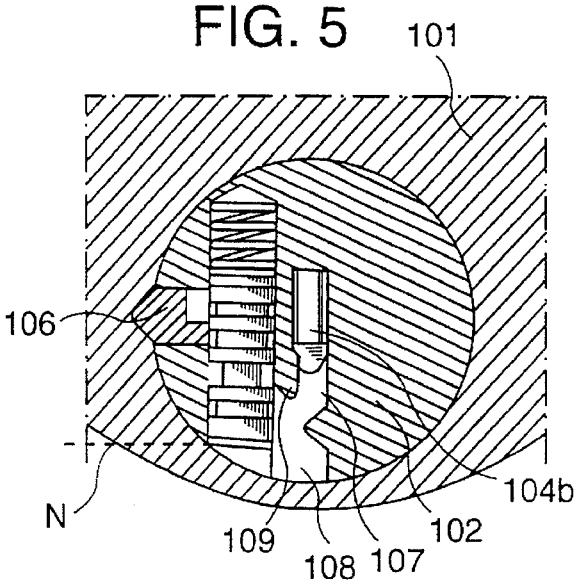

FIG. 6b
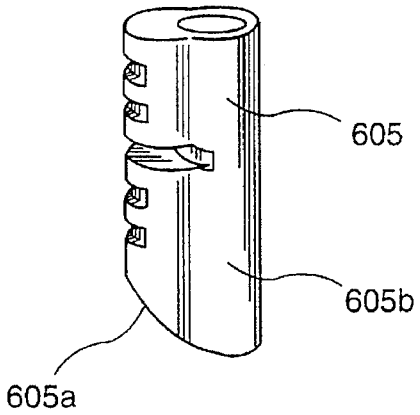
FIG. 6a
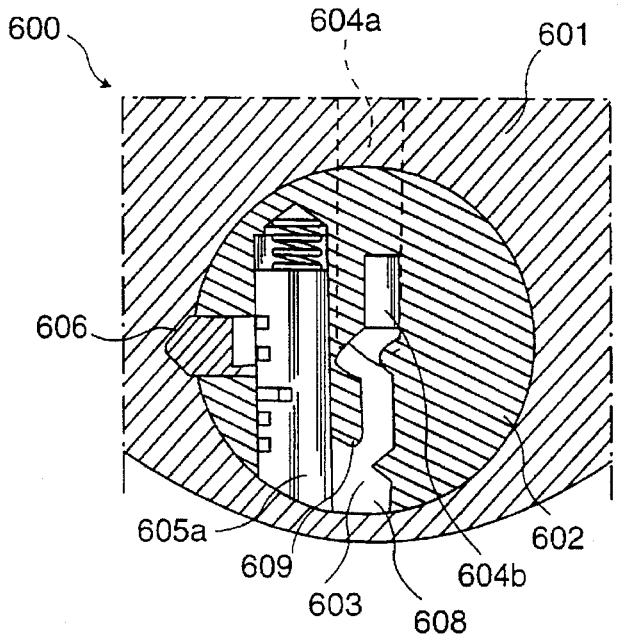
FIG. 7
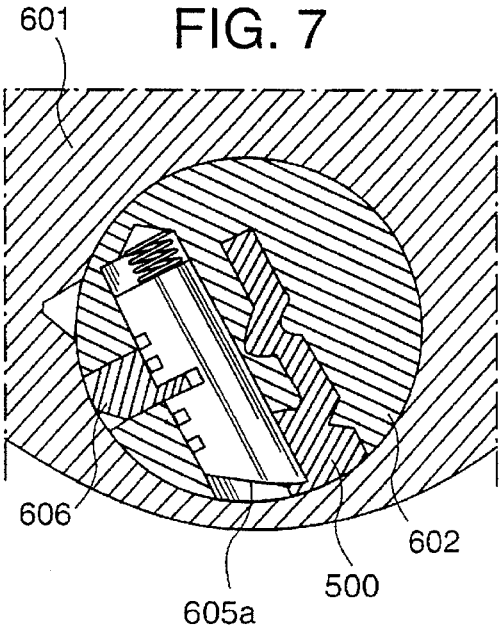
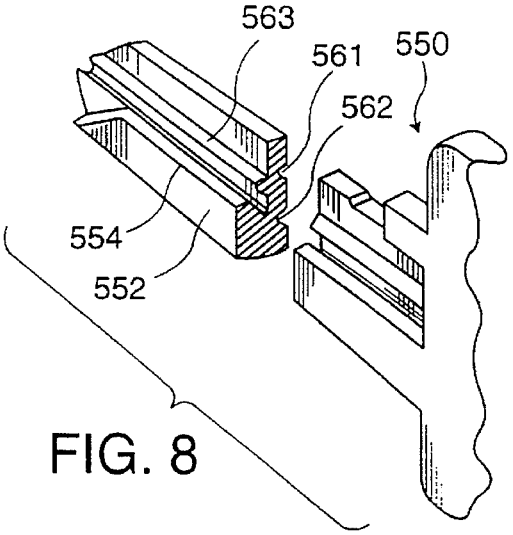
FIG. 8

CYLINDER LOCK AND KEY COMBINATION

BACKGROUND OF THE INVENTION

1. Field of the Invention

The invention relates to a cylinder lock and key combination, wherein the lock comprises a cylinder shell, a cylinder key plug rotdrably mounted in the shell, and wherein the key comprises an essentially flat key blade, which is insertable into a key slot in the longitudinal direction of the cylinder key plug and which has a transversally projecting, solid base portion extending in the longitudinal direction and having side recesses for engagement with a row of side tumblers being movably mounted in the cylinder key plug.

2. Description of Background Art

Such a combination is known from SE-B-7906023-2 (GKN Stenman AB), wherein a side shelf at the upper side of the solid base portion of the key blade is substantially perpendicularly oriented relative to the main plane of the key blade. Side recesses extend downwards from the side shelf for engagement with essentially circular-cylindrical side tumbler pins, which in turn engage with a side bar in the region of the shear line between the shell and cylinder key plug of the lock. The side recesses form a coded pattern with code shelf, which define certain mutually engaging positions of the key and the side tumblers, and transitional portions therebetween, said transitional portions being concavely carved in order to enable a movable linear contact with the end edges of the side tumblers when the key is being inserted into the key slot.

The known lock and key system has proven to function very well and has come to wide spread practical use. However, the system is subject to certain drawbacks, viz.:

- the key is relatively wide and heavy because of solid base portion, which must have a substantial height (in the plane of the key blade) in order to accommodate a plurality of different levels of the code shelfs, so shelfs, so that the desired number of code combinations can be obtained;
- the key slot in the cylinder key plug is by necessity relatively wide in the total height extension corresponding to the solid base portion of the key, which will increase the risk of unauthorized manipulation of the lock by means of picking tools.

Against this background, the object of the present invention is to achieve a lock and key combination which eliminates the above-mentioned drawbacks and which comprises a more slender key and a smaller key slot in the cylinder key plug.

This object is achieved, according to the invention, basically in that the key comprises a lip projecting upwards from the base portion and in that the key slot has a corresponding cross-sectional profile with a downwardly projecting tongue.

As a result of the arrangement with a longitudinal lip, which projects upwards from the solid, wider base portion of the key blade, this solid base potion can be made lower, i.e. having less vertical extension (in the plane of the key blade), since the vertical extension of the lip can also be used for the coded side recesses. Correspondingly, the cross-sectional are of the widened lower part of the key slot will be substantially smaller because of the downwardly projecting tongue, which fits into the space between the lip and the rest of the key blade.

The solid, wider portion of the key blade can be made even lower, if the side tumblers of the lock are non-rotatably guided or rotatable to a limited extent in the cylinder key plug and at least a part of the lower end portion of the respective side tumbler is obliquely curved into conformity with the cylindrical shape of the cylinder key plug.

The side recesses of the key blade may then extend practically all the way down to the lower edge of the key blade, so that the solid, wider base portion of the key blade and the corresponding lower, widened portion of the key slot may obtain a minimal vertical extension.

In case where the side tumblers are non-rotatably guided in the cylinder key plug, the number of code combinations can be further increased in that each side tumbler has an end portion or a side projection, which is specifically longitudinally displaced and which engages with the bottom surface portions of the side recesses of the key, in a corresponding manner as disclosed in the specification U.S. Pat. No. 5,067,335 (Widén). With such a code system, the establishment of a system with master keys and slave keys is facilitated.

Alternatively, the number of code combinations can be increased by making the side tumblers rotatable to a limited extent and positionable in side recesses conformed thereto in the key. The side recesses can then be specifically distributed longitudinally and/or be obliquely positioned.

The invention also relates to a key blank with an upwardly projecting lip, extending at the side along the rest of the key blade. Such a key blank is difficult to manufacture with ordinary locksmith tools. Here, it is an advantage that the manufacture must be made with special equipment in a controlled manner, so that the distribution of key blanks can be controlled and unauthorized production of key blanks is made more difficult.

BRIEF DESCRIPTION OF THE DRAWINGS

The invention will be explained further below with reference to the appended drawings illustrating three different embodiments.

FIG. 1*a* and FIG. 1*b* illustrate in perspective views a lock and a corresponding key, respectively, according to the invention;

FIG. 2 illustrates a key having an alternative configuration of its side recesses;

FIG. 3 illustrates a key blank for making a key according to FIG. 1*b* or 2;

FIG. 4 shows, to a larger scale, a cross-section through the lock according to FIG. 1*a* with an inserted and partially turned key;

FIG. 5 illustrates the lock according to FIG. 1*a* in a locked position (without key);

FIG. 6*a* illustrates, in a cross-sectional view, a second embodiment of a lock according to the invention;

FIG. 6*b* illustrates, to a larger scale, a side tumbler associated with the lock according to FIG. 6*a;*

FIG. 7 illustrates, in a cross-sectional view, the lock according to FIG. 6*a* with an inserted key;

FIG. 8 illustrates, in a perspective view, a key blank for making a key associated with the lock according to FIGS. 6*a* and 7;

DETAILED DESCRIPTION OF THE PREFERRED EMBODIMENTS

Figure 9:
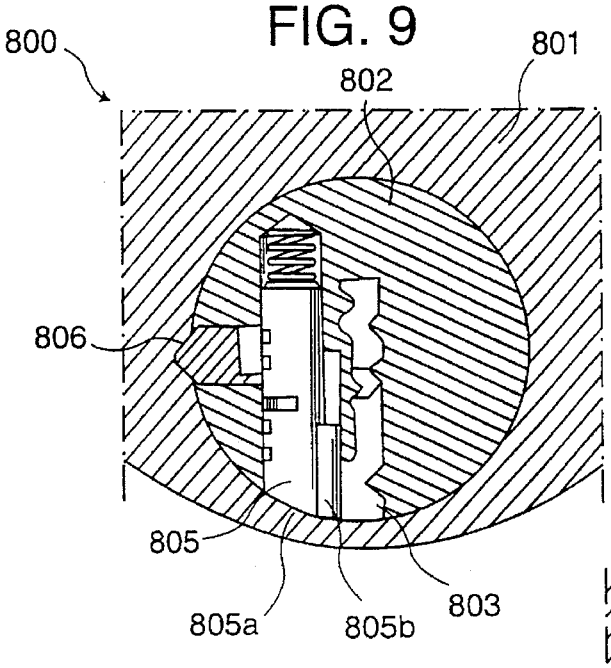
FIG. 9 illustrates, in a cross-sectional view, a third embodiment of a lock according to the invention.

The lock and key combination illustrated in FIGS. 1*a* and 1*b* include a cylinder lock 100 and a key 200. The cylinder lock 100 consists essentially of a shell 101 and a cylinder key plug 102 being rotatable therein and having a longitudinal key slot 103. In a conventional manner, the lock is provided with a row of central, spring loaded tumbler pins 104 with upper and lower pin portions 104*a*, 104*b* in the shell 101 and the cylinder key plug 102, respectively (of FIGS. 4 and 5), the pin portions 104*b* cooperating with coded V-shaped recesses 201 in the upper edge portion of the key 200.

Moreover, substantially as described in the above-mentioned specification SE-B-7906023-2, the cylinder lock 100 has a row of side tumbler pins 105, which are mounted in their entirety in holes in the cylinder key plug 102 so as to cooperate, on the one hand, with a longitudinal side bar 106, which is movable in the region between the shell 101 and the cylinder key plug 102, and, on the other hand, with coded side recesses 202 of the key 200.

When a key 200 associated with the lock has been inserted into the lock 100 and is turned around, the pin portions 104*a*,104*b* as well as the side bar 106 will clear the shear line between the cylinder key plug 102 and the shell 101 so as to release the lock.

The side recesses 202 (and 302 respectively in FIG. 2) may, e.g., be formed with planar side surface portions 203 and smoothly curved bottom surface portions, 204, as illustrated in FIG. 1*b*, or with curved, approximately part-cylindrical side surface portions 303 and planar bottom surface potions 304, as illustrated in FIG. 2 for a modified key 300 with upper recesses 301 and side recesses 302.

The keys 200,300 are made of a key blank 250 according to FIG. 3 having a cross-sectional profile fitting with a certain, required play into the key slot 103. Like the key known from the above-mentioned SE-B-7906023-2, the key blank 250 has a substantially flat, elongate blade part 251 extending in a main plane (through the lines A and B) and having a lower, solid base portion 252. The upper portion 253 of the blade part 251 is much narrower than the base portion 252 and has a substantially uniform thickness, and in this upper portion 2 the V-shaped recesses 201 and 301, respectively, are cut.

The side recesses 202 and 302, respectively, are formed in the solid, wider base portion 252 at the side surface thereof. According to the present invention, the base portion 252 has an upwardly projecting lip extending in the longitudinal direction of the key at a transversal distance from the rest of the key blade, so that a space or longitudinal groove 255 is formed between the lip 254 and the upper portion 253 of the blade part.

As will he seen from a comparision of FIG. 1*b*, FIG. 2 and FIG. 3, the side recesses extend downwardly from the upper edge of the lip 254 and generally down to different levels in the side part of the solid base portion 252. In certain cases the side recesses 202, 302 extend only in the region of the lip 254, whereas in other cases they can extend substantially further down past the bottom of the groove 255. The side recesses 202, 302 thus extend downwardly in certain cases only through the lip 254 and in other cases also through the solid base portion 252.

The lip 254 preferably tapers upwardly and comprises, in the embodiment shown in FIG. 3, an external side surface 256, which extends in the same plane as the side surface of the solid portion 252, an upper relatively narrow surface 257 and an internal, sloping side surface 258, which extends obliquely upwardly and outwardly from the rest of the key blade.

The cross-sectional profile of the key slot 102 corresponds to the profile of the key blank 250 and thus comprises a narrow, upper portion 107 extending substantially in a plane, and a widened, lower portion 108 (corresponding to the base potation 252 of the key blank 250). At the transition between the lower widened portion 108 and the upper portion 107, the cylinder key plug 102 has an obliquely downwardly projecting tongue 109, which fits into the longitudinal groove 252 of the key blank 250 (and the keys 200, 300) and which substantially reduces the size of the key slot 103.

In the embodiment illustrated in FIGS. 1*a*, 2, 4 and 5, corresponding to the lock and key combination described in the above-mentioned SE-B-7906023-2 except for the lip 254 of the key and the tongue 109 of the key slot of the lock, the side tumbler pins 105 are circular-cylindrical and freely rotatable in their circular-cylindrical holes in the cylinder key plug 102. The side tumbler pins 105 will therefore not extend further downwardly than to the level N in FIG. 5 with their lower edge portion. Consequently, the lowest side recesses 302 cannot be located further down than this level N, and the total vertical extension of the base portion 252 and the lip 254 will therefore be substantially greater than the maximum height of the side recesses 302 (as measured in a plane parallel to the main plane of the key through the lines A and B in FIG. 3 ).

In the embodiment according to FIGS. 6*a*, 6*b*, 7 and 8, the lock 600 is substantially like the lock 100 in FIGS. 1*a*, 4 and 5, thus having a rotatable cylinder key plug 602 in a shell 601 and a row of central tumbler pins 604*a*, 604*b* and side tumblers 605. However, the latter are not rotatable about their axes but have a non-circular cross-section, which substantially corresponds to the digit 8, along their total height. Compare FIG. 6*b*. The side tumblers 605, which cooperate with a side bar 606, have a lower obliquely curved portion 605*a*, the curvature of which corresponds to the cylindrical shape of the cylinder key plug. Compare FIGS. 6*a* and 7. The portion of the side tumbler 605 located adjacent to the key slot 603 can extend vertically further downwardly than the side tumbler 105 of the previous embodiment.

Consequently, the solid portion 552 of the key blank 550 (see FIG. 8) can be provided with a smaller height than is the case for the key blank 250 according to FIG. 3. The finished key 500 (see FIG. 7), i.e. with upper recesses and side recesses may therefore be more slender and "flatter", since its solid base portion 552 has a minimal vertical extension, i.e. corresponding to the level differences desired for the side recesses. As illustrated in FIGS. 7 and 8, the cross-sectional profile of the key may be provided with conventional guiding grooves 561, 562 and ridges 563.

The key slot 603 will be correspondingly narrow with a downwardly projecting tongue 609 adjacent to the widened, lower portion 608, which, however, has a small vertical height in this case.

Figure 10:
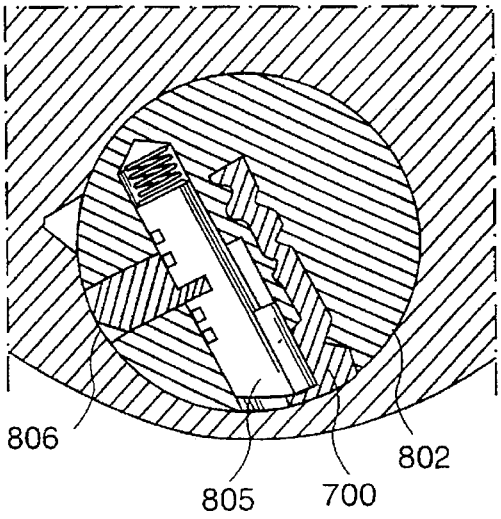
FIG. 10 illustrates the lock according to FIG. 9 with an inserted key.
Figure 11:
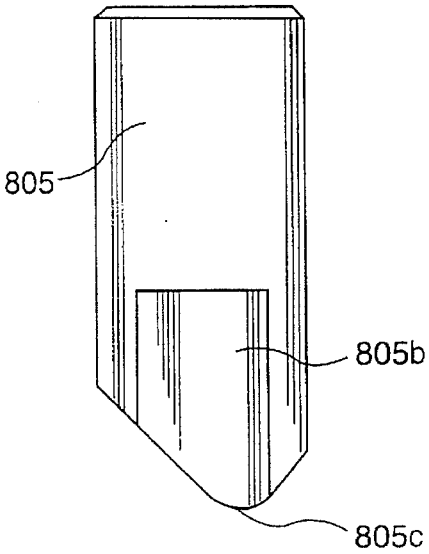
FIG. 11 illustrates, to a larger scale, a side tumbler associated with the lock according to FIGS. 9 and 10.
Figure 12:
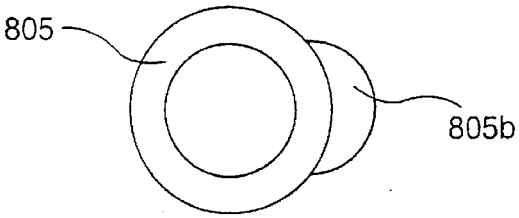
FIG. 12 is a top view of the side tumbler according to FIG. 11.

In FIGS. 9 through 12 there is shown a third embodiment of a lock with a shell 801, a cylinder key plug 802, central tumbler pins (not shown), side tumblers 805, a side bar 806 and a corresponding key 700 (FIG. 10).

The side tumblers 805 are non-rotatably guided in the cylinder key plug 802, like in the previous embodiment, but in this case they are provided with a side projection 805*b*, which has a limited extension vertically (in FIG. 6, the side projection 605b extends along the total height). The side projections 805b have specifically displaced lower end portions 805c in a similar manner as described in U.S. Pat. No. 5,067,335, for engagement with corresponding side recesses of the key, which are specifically displaced in the longitudinal direction. The number of code combinations can be increased or, preferably, be retained in spite of fewer level differences of the side recesses of the key. Consequently, the base portion of the key 700 can in this case be even lower vertically, and the key slot 803 will be correspondingly smaller.

Finally, it should be pointed out that the expressions "upwardly projecting", "upper", "lower", etc refer to the orientation of the key and the lock as illustrated in the drawing figures.

I claim:

1. A cylinder lock and key combination, said cylinder lock comprising:

a shell;

a cylinder key plug rotatably mounted in said shell and having a row of central tumblers and a row of side tumblers disposed therein;

a key slot extending in a longitudinal direction of the cylinder key plug for receiving said key which cooperates with said central and side tumblers in said cylinder key plug;

said key comprising:

an elongated, essentially flat key blade extending in a main plane and having an upper, relatively narrow portion and a lower solid base portion projecting transversely from said main plane, wherein said upper, relatively narrow portion of said key blade is provided with coded upper recesses cooperating with said row of central tumblers, and said lower, transversely projecting solid base portion of said key blade is provided with coded side recesses cooperating with said row of side tumblers, and wherein the upper part of said transversely projecting, solid base portion of the key blade is formed as an upwardly projecting lip which extends in a longitudinal direction at a transversal distance from said main plane of the key blade so as to form a longitudinal groove therebetween, and wherein said lip tapers upwardly towards a free edge surface, said coded side recesses extend from an upper edge of said lip downwardly to different levels in a side surface part of said solid base portion of the key blade, and said key slot of the lock has a cross-sectional profile corresponding to that of said key blade, generally in a main plane, including a relatively narrow upper portion, a widened, lower portion, and a downwardly projecting tongue at the transition between said upper and lower portions, said tongue fitting into said longitudinal groove of the key blade.

2. The cylinder lock according to claim 1, wherein said side tumblers are substantially circular-cylindrical and rotatable about their axes.

3. The cylinder lock according to claim 1, wherein said side tumblers are non-rotatably guided in the cylinder key plug.

4. The cylinder lock according to claim 3, wherein at least a portion of the lower end part of the associated side tumbler is obliquely curved into conformity with the cylindrical shape of the cylinder key plug.

5. The cylinder lock according to claim 3, wherein the lower end portion of the associated side tumbler has a chisel-shaped portion for engagement with bottom surface portions of the side recesses of the key.

6. The cylinder lock according to claim 3, wherein said side tumblers are regularly distributed in said longitudinal direction but have end portions being specifically displaced in said longitudinal direction for engagement with bottom surface portions of the side recesses of the key.

7. The cylinder lock according to claim 3, wherein said side tumblers comprise projections projecting transversely from a circular-cylindrical mantle surface.

8. The cylinder lock according to claim 7, wherein said projections extend only along a part of the axial length of the associated side tumbler.

9. The cylinder lock according to claim 7, wherein said projections extend along the entire axial length of the associated side tumbler.

10. A key for use in combination with an associated lock comprises:

a shell;

a cylinder key plug rotatably mounted in said shell and having a row of central tumblers and a row of side tumblers disposed therein;

a key slot extending in a longitudinal direction of the cylinder key plug for receiving said key which cooperates with said central and side tumblers in said cylinder key plug;

and the key comprising:

an elongated, essentially flat key blade extending in a main plane and having an upper, relatively narrow portion and a lower solid base portion projecting transversely from said main plane, wherein said upper, relatively narrow portion of said key blade is provided with coded upper recesses cooperating with said row of central tumblers, and said lower, transversely projecting solid base portion of said key blade is provided with coded side recesses cooperating with said row of side tumblers, and wherein the upper part of said transversely projecting, solid base portion of the key blade is formed as an upwardly projecting lip which extends in a longitudinal direction at a transversal distance from said main plane of the key blade so as to form a longitudinal groove therebetween, and wherein said lip tapers upwardly towards a free edge surface, said coded side recesses extend from an upper edge of said lip downwardly to different levels in a side surface part of said solid base portion of the key blade, and said key being insertable into a key slot of the lock wherein the key slot includes a cross-sectional profile corresponding to that of said key blade, generally in a main plane, including a relatively narrow upper portion, a widened, lower portion, and a downwardly projecting tongue at the transition between said upper and lower portions, said tongue fitting into said longitudinal groove of the key blade.

11. The key according to claim 10, wherein a side surface of the lip, which faces towards said upper, relatively narrow portion of the key blade, extends obliquely upwardly and outwardly from said solid base portion.

12. The key according to claim 10, wherein said coded side recesses include concavely curved side surface portions.

13. The key according to claim 10, wherein said coded side recesses include planar bottom surface portions.

14. The key according to claim 10, wherein said coded side recesses include planar side surface portions.

15. The key according to claim 10, wherein said coded side recesses have smoothly curved bottom surface portions.

16. A key blank for making a key according to claim 10, wherein an essentially flat blade part of the key blank extends in a main plane and comprises an upper, relatively narrow portion and a lower solid base portion projecting transversely from said main plane, and wherein the upper, relatively narrow portion is intended to be provided with coded upper recesses, whereas the lower base portion is intended to be provided with coded side recesses, and wherein said upper part of said transversely projecting, solid base portion of the key blade is formed as an upwardly projecting lip which extends in a longitudinal direction at a transversal distance from said main plane of the key blade so as to form a longitudinal groove therebetween.

17. A cylinder lock and key combination, said cylinder lock comprising:

a shell;

a cylinder key plug rotatably mounted in said shell and having a row of central tumblers and a row of side tumblers disposed therein, said side tumblers being non-rotatably guided in the cylinder key plug and comprise projections projecting transversely from a circular-cylindrical mantle surface and said projections extend along the entire axial length of the associated side tumbler;

a key slot extending in a longitudinal direction of the cylinder key plug for receiving said key which cooperates with said central and side tumblers in said cylinder key plug;

said key comprising:

an elongated, essentially flat key blade extending in a main plane and having an upper, relatively narrow portion and a lower solid base portion projecting transversely from said main plane, wherein said upper, relatively narrow portion of said key blade is provided with coded upper recesses cooperating with said row of central tumblers, and said lower, transversely projecting solid base portion of said key blade is provided with coded side recesses cooperating with said row of side tumblers, and wherein the upper part of said transversely projecting, solid base portion of the key blade is formed as an upwardly projecting lip which extends in a longitudinal direction at a transversal distance from said main plane of the key blade so as to form a longitudinal groove therebetween, said coded side recesses extend from an upper edge of said lip downwardly to different levels in a side surface part of said solid base portion of the key blade, and said key slot of the lock has a cross-sectional profile corresponding to that of said key blade, generally in a main plane, including a relatively narrow upper portion, a widened, lower portion, and a downwardly projecting tongue at the transition between said upper and lower portions, said tongue fitting into said longitudinal groove of the key blade.

18. The cylinder lock according to claim 17, wherein said side tumblers are substantially circular-cylindrical and rotatable about their axes.

19. The cylinder lock according to claim 17, wherein at least a portion of the lower end part of the associated side tumbler is obliquely curved into conformity with the cylindrical shape of the cylinder key plug.

20. The cylinder lock according to claim 17, wherein the lower end portion of the associated side tumbler has a chisel-shaped portion for engagement with bottom surface portions of the side recesses of the key.

21. The cylinder lock according to claim 17, wherein said side tumblers are regularly distributed in said longitudinal direction but have end portions being specifically displaced in said longitudinal direction for engagement with bottom surface portions of the side recesses of the key.

22. The cylinder lock according to claim 17, wherein said projections extend only along a part of the axial length of the associated side tumbler.

* * * * *